US009174074B2

(12) United States Patent
Medina

(10) Patent No.: US 9,174,074 B2
(45) Date of Patent: Nov. 3, 2015

(54) TOXIC FUME INJECTOR FOR EXTINGUISHING FOREST FIRES

(71) Applicant: Juan Manuel Medina, Tijuana (MX)

(72) Inventor: Juan Manuel Medina, Tijuana (MX)

( * ) Notice: Subject to any disclaimer, the term of this patent is extended or adjusted under 35 U.S.C. 154(b) by 160 days.

(21) Appl. No.: 13/831,479

(22) Filed: Mar. 14, 2013

(65) Prior Publication Data

US 2013/0264076 A1 Oct. 10, 2013

Related U.S. Application Data

(60) Provisional application No. 61/619,896, filed on Apr. 3, 2012.

(51) Int. Cl.

| | |
|---|---|
| ***A62C 3/02*** | (2006.01) |
| ***A62C 2/06*** | (2006.01) |
| *A62C 99/00* | (2010.01) |

(52) U.S. Cl.

CPC ..... *A62C 3/0257* (2013.01); *A62C 2/06* (2013.01); *A62C 3/0228* (2013.01); *A62C 99/0009* (2013.01)

(58) Field of Classification Search

CPC ..... A62C 99/0009; A62C 2/06; A62C 2/065; A62C 2/10; A62C 99/0018; A62C 3/08; A62C 3/0228; A62C 3/0257

USPC ..... 169/48, 49, 50

See application file for complete search history.

(56) References Cited

U.S. PATENT DOCUMENTS

| | | | | |
|---|---|---|---|---|
| 3,687,185 | A * | 8/1972 | Singer | 160/1 |
| 2009/0139736 | A1* | 6/2009 | Medina | 169/54 |
| 2011/0180278 | A1* | 7/2011 | Magnay et al. | 169/48 |

* cited by examiner

*Primary Examiner* — Arthur O Hall
*Assistant Examiner* — Juan C Barrera

(57) ABSTRACT

A fire extinguishing apparatus comprising of a metal dome, a deformable cylindrical section that can store a volume of gas, and a plurality of hanging canvases, around its perimeter as well as internally. Said volume of gas is the by-product of combustion, which is captured once the apparatus is place over and encapsulates the fire. As the apparatus is lowered onto the fire, the perimeter canvases form a seal, limiting the amount of oxygen inside the volume. As the fire consumes this limited amount of oxygen, the toxic gases produced are stored in its chamber, the apparatus continues being lowered onto the fire were the compression canvases compact the fire flames, extinguishing them. Furthermore, as the device continues to be lowered even further, the deformable cylindrical section begins to displace its stored volume of gases on to the encapsulated fire, displacing any remaining oxygen and stopping the combustion process.

3 Claims, 10 Drawing Sheets

TOXIC FUME INJECTOR FOR EXTINGUISHING FOREST FIRES

CROSS-REFERENCE TO RELATED APPLICATIONS

Figure 1:
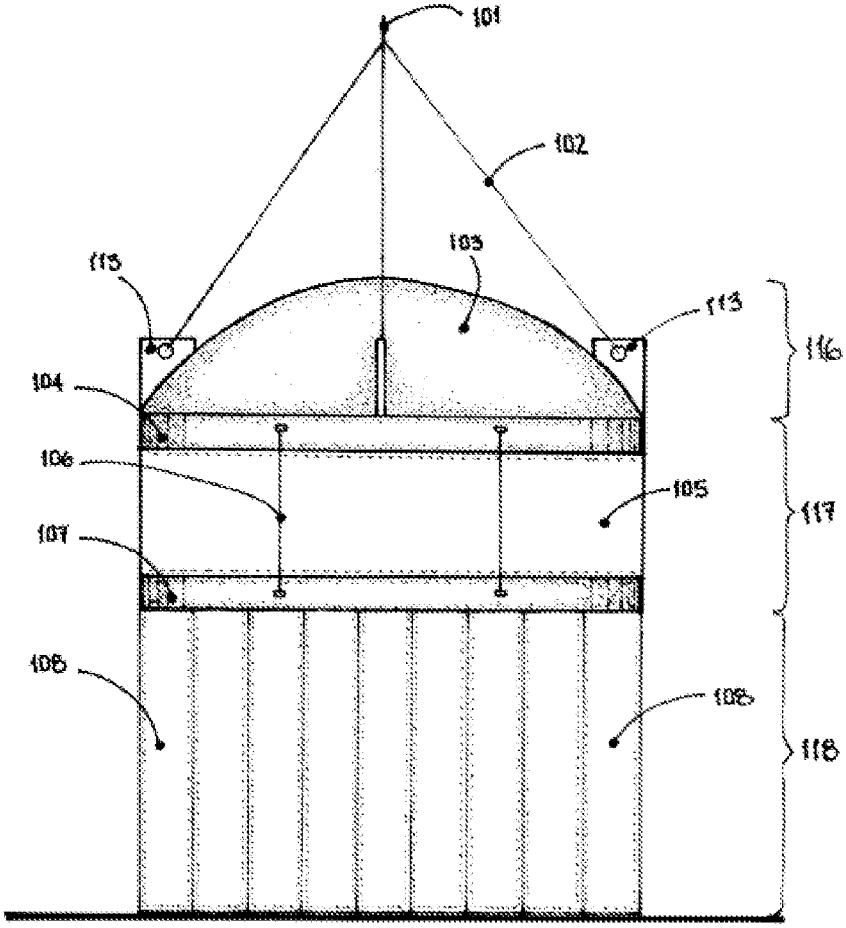

This application claims benefit of provisional patent application Ser. No. 61/619,896, filed 2012 Apr. 3 by the present inventor.

This application is related to application Ser. No. 12/080,617, filed 4 Apr. 2008, now U.S. Pat. No. 8,118,108, granted 21 Feb. 2012.

FEDERALLY SPONSORED RESEARCH

Not Applicable

SEQUENCE LISTING OR PROGRAM

Not Applicable

BACKGROUND

1. Field of Invention

This invention relates and is aimed at extinguishing fires mechanically, in particular extinguishing forest fires.

2. Prior Art

Through the years, huge amounts of financial and technological resources have been applied to find and achieve a system, method or device, to control fires. The results and the scientific contributions, until recently, have not shown many variations; chemical retardants or water are still used in the same fashion, thrown on flames or fires. And although these systems give very questionable results, there is really an inefficient amount of time spent recharging the systems, and that's what makes traditional systems very inefficient.

That's why in every forest fire season, anywhere around the world, great damages and losses of all types are caused; natural resources, economic, and in some cases even human lives.

This invention, toxic gas injector, is the solution to neutralize fires with minimal effort and in a very decisive way, but the main thing is that the toxic gas injector acts mechanically, without using any liquid or chemical retardants, so the equipment operators of the toxic gas injectors will not need to withdraw from the fire fighting zone for a recharge, they remain in the area of the incident forming a strong barrier in the fire zone.

The main motivation in creating this invention is how the device works quickly with high effectiveness in attacking the fire area. It saves a lot of time in the process of fire extinction, if we consider the enormous strength of how the device works when the toxic gas injector is deposited on any type of flame, as the fire is completely smothered in the absence of oxygen and compression of the flames by the same device, so that the fire has no chance to continue the combustion process. So if we take into account the above, it follows that this invention toxic gas injector is totally new and unique.

Here are some of the previously patented technologies described as prior art.

Combustion Process Stopper CPS U.S. Pat. No. 8,118,108 consists of an airtight flexible chamber, although the function thereof among other things is to form a seal with the ground where it is deposited and avoids the inclusion of oxygen into the chamber, and the combustion process stops the fire by lack of oxygen. The results are obtained very slowly and you have to wait until the fire consumes all the oxygen that was caught previously in the sealed chamber of the device. And although it manages to extinguish the fire, the size of the tree or bush that is on fire should perfectly be enclosed or covered by the CPS device.

This practice is not always presented as the sizes and shapes of trees and shrubs vary widely, which sometimes does not allow the device Combustion Process Stopper CPS, to cover the entire area of fire to attack and that may allow for more oxygen to flow to the inside from the outside of the chamber and can permit the combustion process to remain active.

There is also the technology by U.S. Pat. No. 3,687,185 by Isadore Singer. This invention relates to a set of curtains that are packaged and deployed vertically downward it is intended to prevent the spread of fire to a specific area that is bounded by these curtains.

Although these curtains form a sort of shield against fires that want to enter the area protected by them, the problem is that it does not generate an airtight barrier, as the roof is fully open and the connection between them allows oxygen flow in both directions and does not form a sealing joint between curtain and curtain.

Another problem created by this invention is that it only defines and protects a certain area and cannot be used in other affected areas, so it is a system or set of curtains for a single fire.

Technology by M. A. Freedman presented in U.S. Pat. No. 3,209,837, and whose invention consists of fabric rolls that are placed horizontally and contain therein powder retardant chemicals. These can be thrown on the fire once it is activated by a device that allows a vertical fall by gravity and rolls of cloth wrapped in chemicals expel these powders on the fire. However, the dust will fall upon only the area delimited by these cabinets containing these rolls and chemical containers, once the system is activated by temperature or manually.

Another limitation presented by this invention is that it can be used only once, to reuse the system, it must be recharged and placed back in its original position. Time spent on reuse is quite considerable.

The invention U.S. Pat. No. 5,331,956 submitted by Mickey M. Bailey is a blanket or sheet that is manually removed from the back of a seat in aircrafts, and that protects the passenger from fire that might occur in aircraft.

However, this system is very limited as each seat uses a blanket or sheet and becomes of fully personal use, and may not be used in other areas of fire fighting; the system blocks the fire from outside to protect the body by the blanket.

The system does not generate a sealed chamber when activated, allowing the flow of oxygen to the interior and does not extinguish the fire so that it only protects from the fire.

SUMMARY

In accordance with one embodiment a toxic fume injector comprises of a dome structure which supports a flexible cylindrical airtight chamber and a structural member to support a plurality of hanging canvas strips on its inside and around its perimeter. The perimeter canvases form a seal with the ground when lowered on to a burning fire and the interior canvases collapse upon the fire, extinguishing and at the same time the dome structure captures toxic fumes which can soon after be injected on to the remaining smoldering fire depriving it of the oxygen needed to sustain combustion and consequently extinguish said fire.

DRAWINGS

Figures

In the drawings, closely related figures have the same number.

FIG. 1 Main view of the preferred embodiment.

Figure 2:
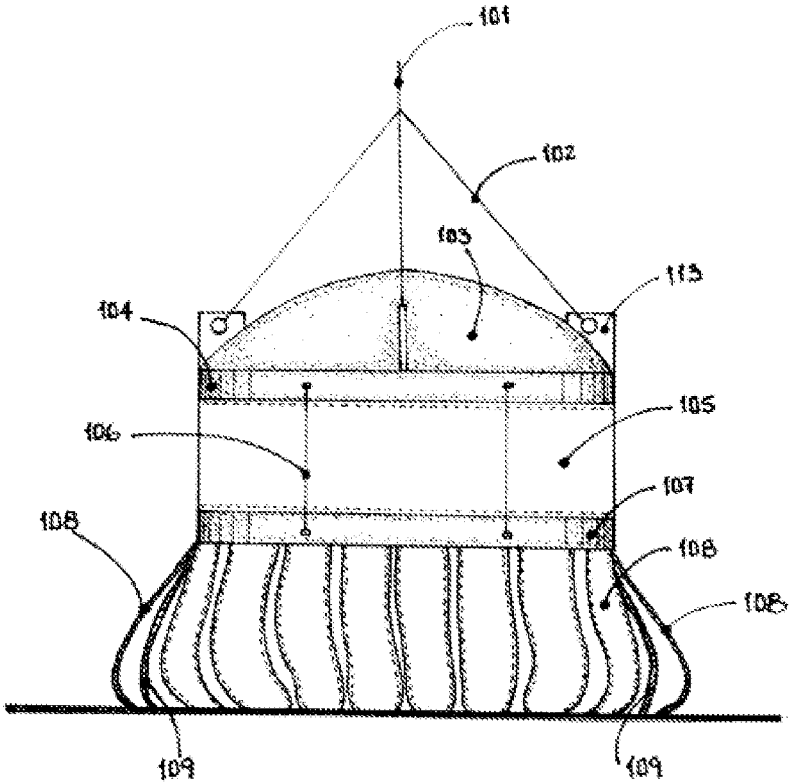

FIG. 2 View of initial deformation of exterior sealing canvases and compression canvases.

Figure 3:
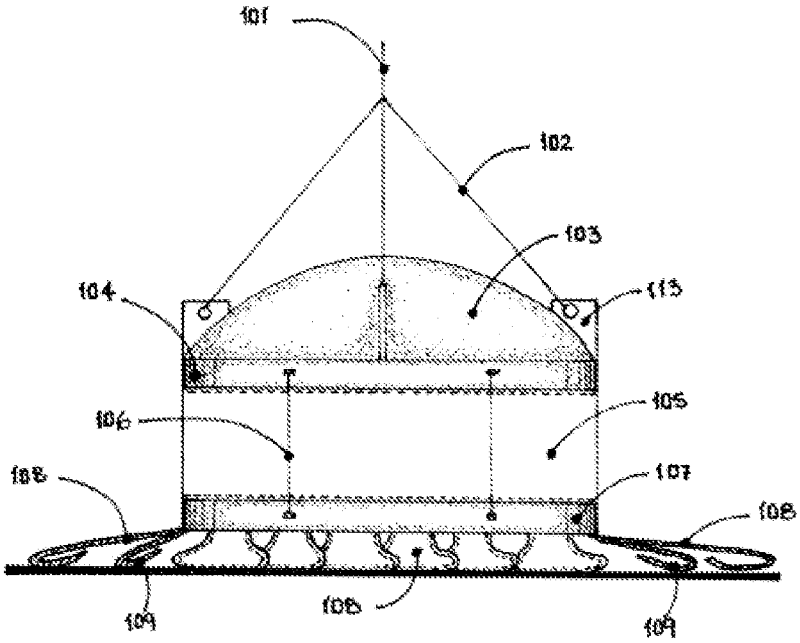

FIG. 3 View of preferred embodiment on ground showing exterior sealing canvases and interior sealing canvases compressed.

Figure 4:
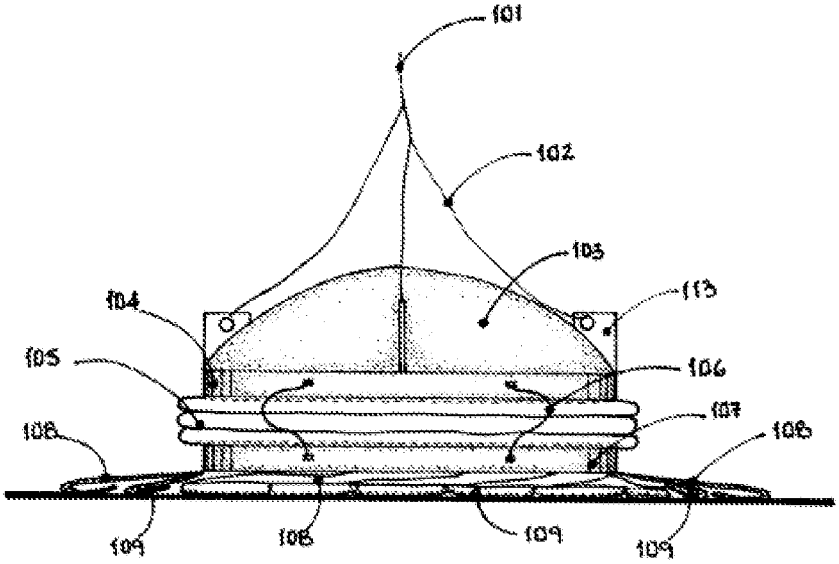

FIG. 4 View of flexible airtight chamber being compress and expelling internal volume of gas.

Figure 5:
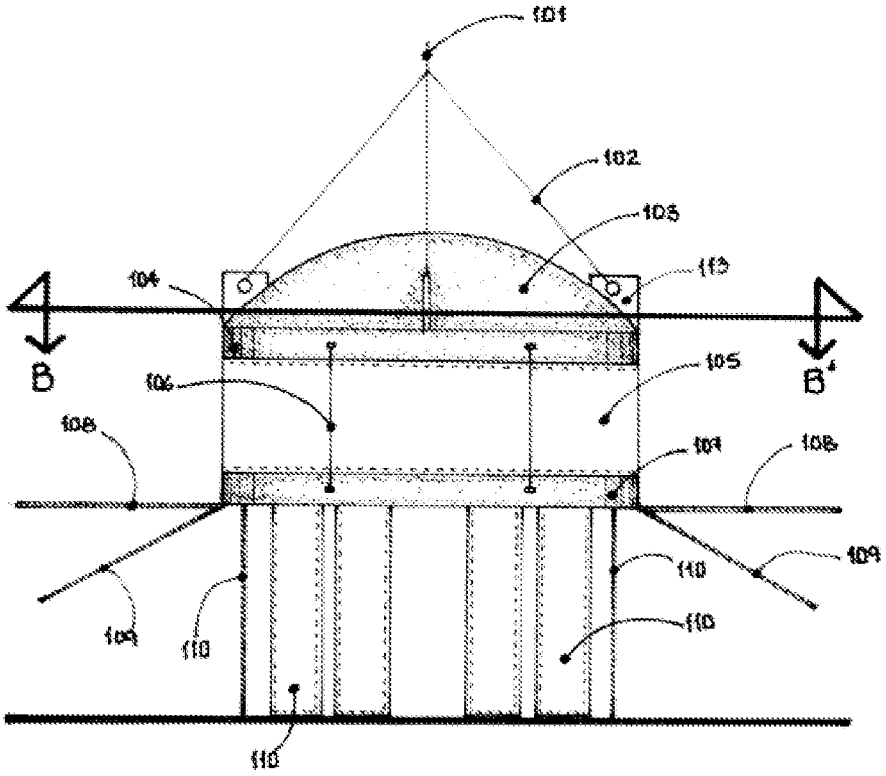

FIG. 5 View of flexible airtight chamber and hanging exterior sealing canvases and interior sealing canvases, and also showing location of section B-B'.

Figure 6:
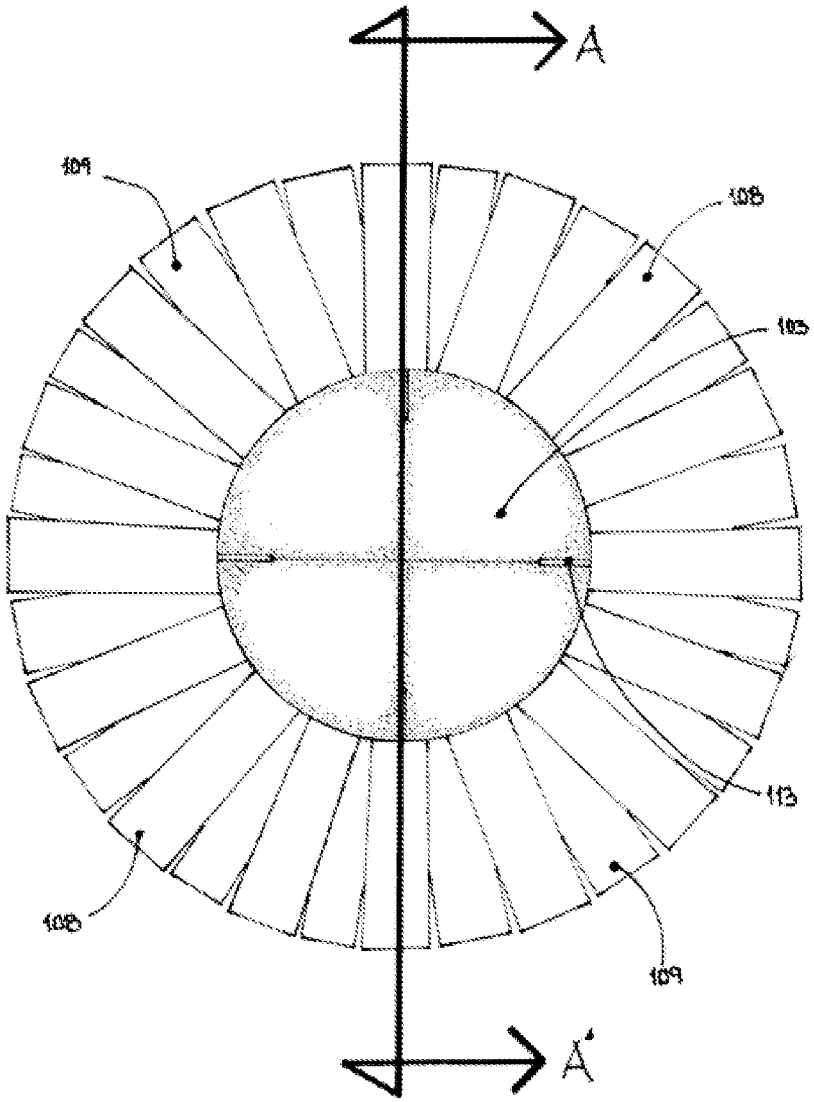

FIG. 6 Top view of the preferred embodiment, shown with internal and external canvases fanned out and also showing location of section A-A'.

Figure 7:
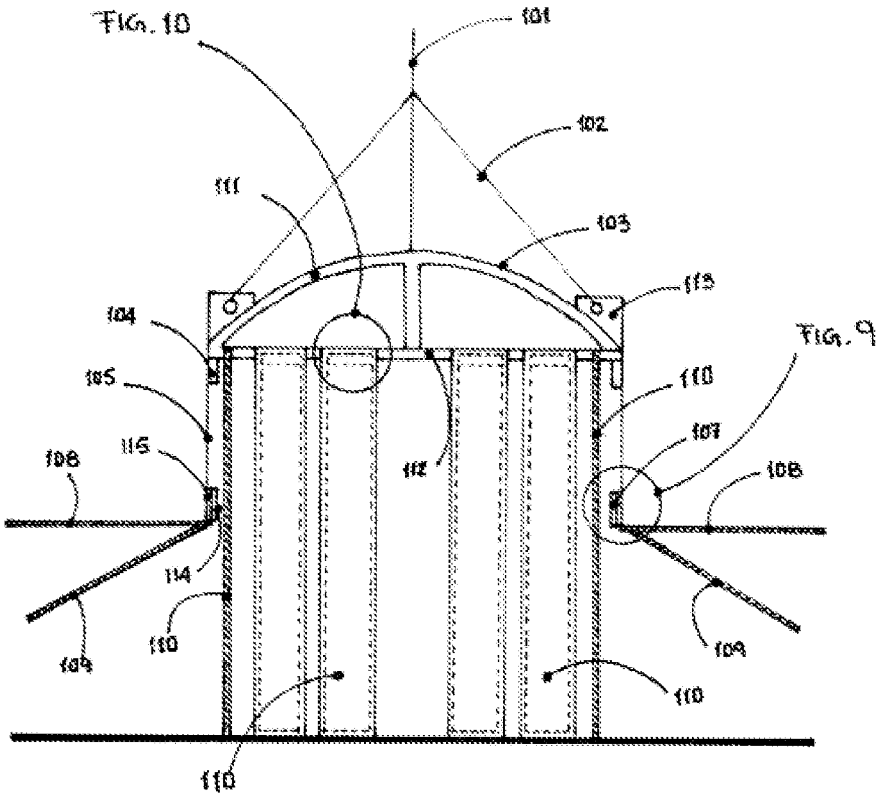

FIG. 7 View of section A-A'.

Figure 8:
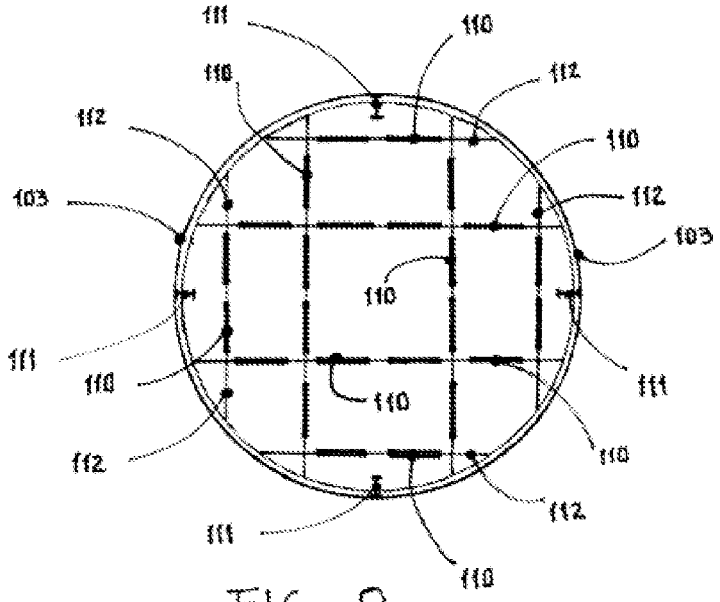

FIG. 8 View of section B-B'.

Figure 9:
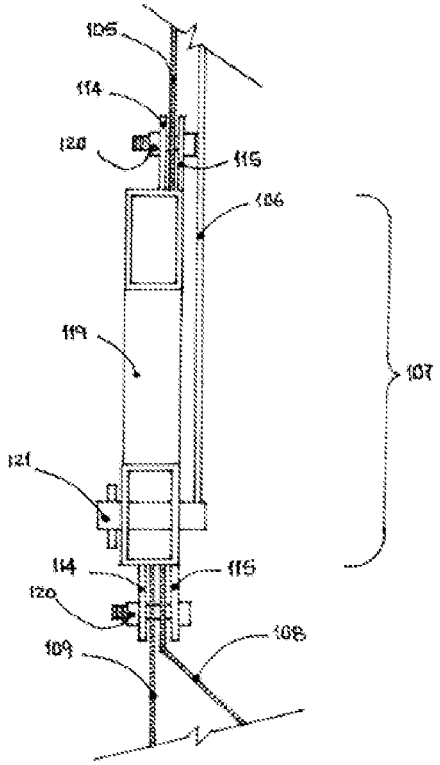

FIG. 9 Detail view of lower circular frame assembly.

Figure 10:
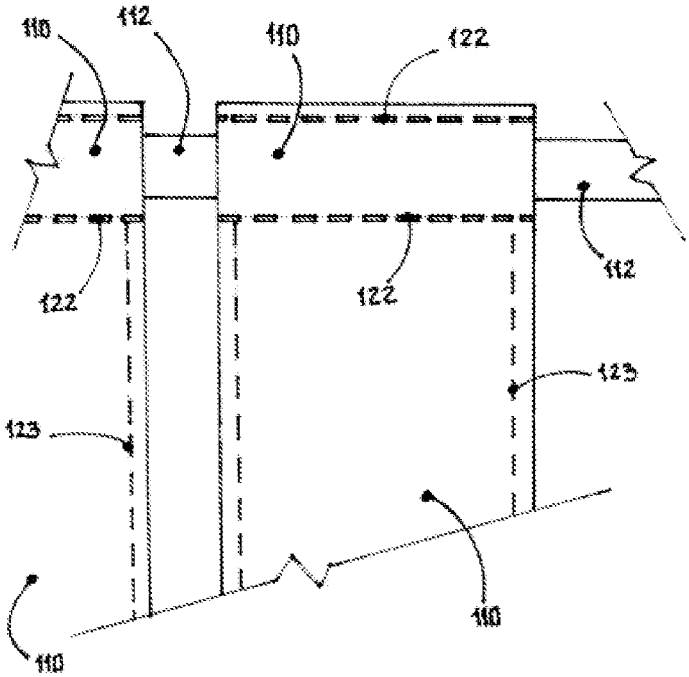

FIG. 10 Detail view of double stitching of canvases.

DRAWINGS

Reference Numerals

| | |
|---|---|
| 101 | load cable |
| 102 | stabilizing support cable |
| 103 | exterior dome panels |
| 104 | upper circular frame |
| 105 | exterior canvases of the airtight chamber |
| 106 | limiting cables |
| 107 | lower circular frame |
| 108 | exterior sealing canvases |
| 109 | interior sealing canvases |
| 110 | compression canvases |
| 111 | primary beams |
| 112 | support beams for compression canvases |
| 113 | stabilizers |
| 114 | interior metallic ring |
| 115 | exterior metallic ring |
| 116 | Semispherical metallic cavity |
| 117 | flexible airtight chamber |
| 118 | compression and sealing chamber |
| 119 | structural member |
| 120 | bolt and nut |
| 121 | bolt pin |
| 122 | canvas double seam |
| 123 | canvas union |

DETAILED DESCRIPTION

FIG. 1 Through FIG. 10

Preferred Embodiment

The preferred embodiment of the toxic gas injector is composed of 3 main sections.

The first section is the semispherical metallic cavity (116), composed of exterior dome panels (103), which are welded or bolted to the primary beams (111) and stabilizers (113), which will be fixed to the stabilizing support cables (102) which join the load cable (101).

Likewise the support beams for compression canvases (112) for the compression canvases (110) are anchored to the upper circular frame (104) by riveting or welding.

All these parts form the metallic structure for vertical upward (+) and downward (−) travel load of the whole system of the toxic gas injector.

The second section of the toxic gas injector, is the flexible airtight chamber (117), it consist of the upper circular frame (104) which will be welded to the primary beams (111).

The exterior canvases of the airtight chamber (105), of the flexible airtight chamber (117), will be attached to the upper circular frame (104) at the top and the same exterior canvases of the airtight chamber (105) will be attached on their lower part to the lower circular frame (107). The lower circular frame (107) is formed by the structural element (119), the screw and nut (120), and the bolt pin (121), and this will be suspended at the bottom of the flexible airtight chamber (117) via limiting cables (106) to be connected directly to the upper circular frame (104) by screws and connectors.

The semispherical metallic cavity (116) as well as the flexible airtight chamber (117) will form the body that holds the toxic fumes produced by the fire.

The third section of the toxic gas injector is the compression and sealing section (118). This chamber is formed by the exterior sealing canvases (108) which are supported on the bottom of the lower circular frame (107) using a two metal ring system; the interior metallic ring (114) and the exterior metallic ring (115), with bolt and nut (120), FIG. 9. Likewise interior sealing canvases (109) will be attached to the bottom of the lower circular frame (107) using the same interior metallic ring (114) and the exterior metallic ring (115), with bolt and nut (120) mentioned above, but with an overlap between the exterior sealing canvases (108) and the interior sealing canvases (109) as shown in FIG. 6 since when depositing the toxic gas injector on to the fire area the seal exterior sealing canvases (108) generate an opening between parts, so that the interior sealing canvases (109) cover this gap in the inner part of the device perimeter of the toxic gas injector.

In the same manner, the exterior sealing canvases (108) will cover the openings that are generated in the interior sealing canvases (109) when placed over the fire area, so that the overlap of these two bodies form a seal over all the perimeter preventing the entry or flow of oxygen from outside into the chamber, the fire will be starved of the supply of oxygen into the device, the toxic gas injector, in a very efficient way.

The compression canvases (110) will be attached to the support beams for compression canvases (112) by sewing with a canvas double seam (122) as well as with the bottom canvas double stitching (122), FIG. 10, obtaining a total adjustment to prevent horizontal displacement in the support beams for compression canvases (112). Also, these compression canvases (110) will be joined by a canvas union seam (123) to increase its size.

Likewise the support beams for compression canvases (112) have an arrangement forming a lattice, as shown in FIG. 8, so that once the compression canvases (110) are placed on the support beams for compression canvases (112) and are compressed by the collapse action of the toxic gas injector, these compression canvases (110) to work in both directions, in order to increase efficiency of crushing on the flames, FIG. 4.

All the canvases, both the exterior sealing canvases (108), the interior sealing canvases (109), and the compression canvases (110), work by the downward force due to gravity and by that effect recover their original position of FIG. 1 once the work cycle is completed.

The exterior canvases of the airtight chamber (105) are manipulated by upper circular frame (104) and the lower circular frame (107), to recover its position after completion of the work cycle.

Operation

FIG. 1 Through FIG. 10

The toxic gas injector will work to extinguish fires by a cycle of 4 actions, which are almost simultaneous once the embodiment is placed over the burning area.

First Action:

Will form a seal surrounding the fire fought by the device, FIG. 2, using the exterior sealing canvases (108), and the interior sealing canvases (109), which will avoid oxygen flow from outside to the inside of the flexible airtight chamber (117) formed by the parts, upper circular frame (104), exterior canvases of the airtight chamber (105), limiting cables (106) and lower circular frame (107).

Second Action:

This will compress the fire flames by the compression canvases (110) that are suspended inside the flexible airtight chamber (117) by the support beams for compression canvases (112).

These compression canvases (110) will crush the flames, starving them of the necessary oxygen to sustain combustion, starting a gradual extinction of the fire and in turn generating large quantities of toxic gases, which will be captured and stored in the flexible airtight chamber (117), FIG. 1.

Third Action:

Will capture and store the toxic gases in the flexible airtight chamber (117), produced by the fire that will be crushed by compression canvases (110), and by the exterior sealing canvases (108) and the interior sealing canvases (109), starting to gradually choke and efficiently generating toxic gases to be stored in the flexible airtight chamber (117). At this point we will have a lack of oxygen inside the sealed flexible airtight chamber (117) and it will flex, crushing compression canvases (110) managing to extinguish the flames, FIG. 3.

Fourth Action:

The last action is performed by injecting toxic gases stored in the flexible airtight chamber (117) on the remaining flames trapped under the exterior sealing canvases (108), the interior sealing canvases (109), and the compression canvases (110). By injecting these toxic gases on the remaining flames, it further stops the combustion process by fully displacing any remaining oxygen needed to sustain such combustion, FIG. 4.

This final action is performed by dropping by gravity, vertically downward (−), the hemispherical metal section formed by the exterior dome panels (103), upper circular frame (104) and primary beams (111). This downward vertical displacement (−) of this hemispherical metal section, exerts a pressure on the toxic gas volume trapped inside the flexible airtight chamber (117), injecting the gas into the flames that may remain active even when inside the flexible airtight chamber (117) and with great force expelling to the outside of the machine the toxic gases, FIG. 4. In other words the device works as an air piston, generating a toxic gas shock wave out of the device, so that not only is fire extinguished inside the flexible airtight chamber (117), but also much of the fire in the outer periphery of the device will be extinguished.

Once the content of toxic gases has been expelled outward of the device, FIG. 4, the next step will be to let the device stand for a few seconds in this position, to finish extinguishing the flames completely and in a highly efficient way. The 4 actions performed by this device on the flames will be devastating to the fire it has fought.

After a few seconds the device will be raised slowly and vertically upward (+) and the exterior sealing canvases (108), the interior sealing canvases (109), compression canvases (110) and exterior canvases of the airtight chamber (105), slowly regain their form as shown in FIG. 2, until it reaches its original position of FIG. 1, and be in a position to begin a new cycle of attack.

Once the fire in the area that was fought is extinguished, the device can be moved to the next area in fire, so that the whole process of 4 actions is repeated.

These devices can be used for firefighting mainly on horizontal fires and can be transported by helicopter when treating high intensity fires, but can also be carried personally to attack grass and shrub fires, as an embodiment of this invention can be fabricated in a portable, lightweight size but with the same effects on fires.

I claim:

1. A fire extinguishing apparatus, having a top rigid metallic dome member that defines an upper metallic circular frame, wherein a flexible chamber composed of a first set of exterior flexible canvases are suspended from said upper metallic circular frame, and contains a set of metallic bars across the interior of said upper circular frame, which form an internal configuration; wherein a set of internal compression canvases are suspended from said set of metallic bars, which attack the fire through encapsulation and compression and thereby reduce the amount of air that surrounds the flames and stops the combustion process efficiently; wherein said set of internal compression canvases compress and deform without obstructing each other and thus efficiently suppresses the flames; wherein said flexible chamber has attached on a lower end a lower metallic circular frame, wherein a second set of exterior flexible canvases are suspended from the lower metallic circular frame, which extend the original area covered by the apparatus and thus increase the apparatus' attack capacity; wherein said set of internal compression canvases and said second set of exterior flexible canvases have a length that when the apparatus is not collapsed, both sets of canvases touch the ground; and wherein both sets of flexible canvases are compacted when the apparatus is collapsed and recover their initial form after the apparatus is taken to a non-collapsed position.

2. The fire extinguishing apparatus as disclosed by claim 1, wherein the flexible chamber stores toxic fumes produced by the combustion process of the fire encapsulated by the apparatus which when transported to another fire area, suffocates the flames in a more efficient way, due to said flexible chamber containing reduced levels or lack of oxygen.

3. The fire extinguishing apparatus as disclosed by claim 1, wherein the flexible chamber stores toxic fumes produced by the combustion process of the fire encapsulated by the apparatus which are ejected through compression of said flexible chamber and thus suffocates the flames in the interior as well as flames in the area surrounding the apparatus.

* * * * *